United States Patent [19]

Fleissner

[11] Patent Number: 4,848,222

[45] Date of Patent: Jul. 18, 1989

[54] PROCESS AND APPARATUS FOR COMPRESSING FIBROUS MATERIAL INTO BALES

[75] Inventor: Gerold Fleissner, Chur, Switzerland

[73] Assignee: Vepa AG, Riehen, Switzerland

[21] Appl. No.: 106,870

[22] Filed: Oct. 13, 1987

[30] Foreign Application Priority Data

Oct. 13, 1986 [DE] Fed. Rep. of Germany ..... 3634817

[51] Int. Cl.[4] ..... B30B 13/00; B30B 15/06; B65B 1/24; B65B 13/20

[52] U.S. Cl. ..... 100/35; 53/438; 53/529; 100/229 A; 100/246

[58] Field of Search ..... 53/438, 523, 527, 528, 53/529, 530, 436; 100/193, 195, 196, 208, 209, 214, 218, 229 A, 240, 246

[56] References Cited

U.S. PATENT DOCUMENTS

| | | | |
|---|---|---|---|
| 2,763,973 | 9/1956 | Atkins | 53/436 |
| 3,099,952 | 8/1963 | Dixon et al. | 53/528 X |
| 4,372,101 | 2/1983 | Fleissner | 53/529 X |
| 4,408,438 | 10/1983 | Rewitzer | 53/528 X |
| 4,463,669 | 8/1984 | Van Doorn et al. | 100/246 X |
| 4,685,391 | 8/1987 | Picker | 53/527 X |

*Primary Examiner*—Robert L. Spruill
*Assistant Examiner*—Beth Bianca
*Attorney, Agent, or Firm*—Antonelli, Terry & Wands

[57] ABSTRACT

A process for the transportation and subsequent final compression of, for example, synthetic fiber material from rough filling presses to a central press utilizes thin-walled filling bins for the initial precompression. In the rough presses, the fiber material is deposited into the thin-walled filling bins, the filling bins are then transported to the central press, transferred at that location one after the other into the compressing position of the central press, thereafter an additional compression bin is placed over the filling bin in such a way that the walls of the filling bin are in close contact with the inner surface of the walls of the compression bin, and finally the final compression step is performed. With a final compacting pressure being maintained unchanged, the filling bin as well as the walls of the compression bin are pulled off in the upward direction in order to make it possible to package and reinforce the finished bale. After the bale has been carried away, the jacket of the filling bin is shifted downwards relatively to the jacket of the compression bin and reunited with the bottom of the filling bin.

10 Claims, 1 Drawing Sheet

PROCESS AND APPARATUS FOR COMPRESSING FIBROUS MATERIAL INTO BALES

Figures 1, 2, 3, 4, 5, 6:
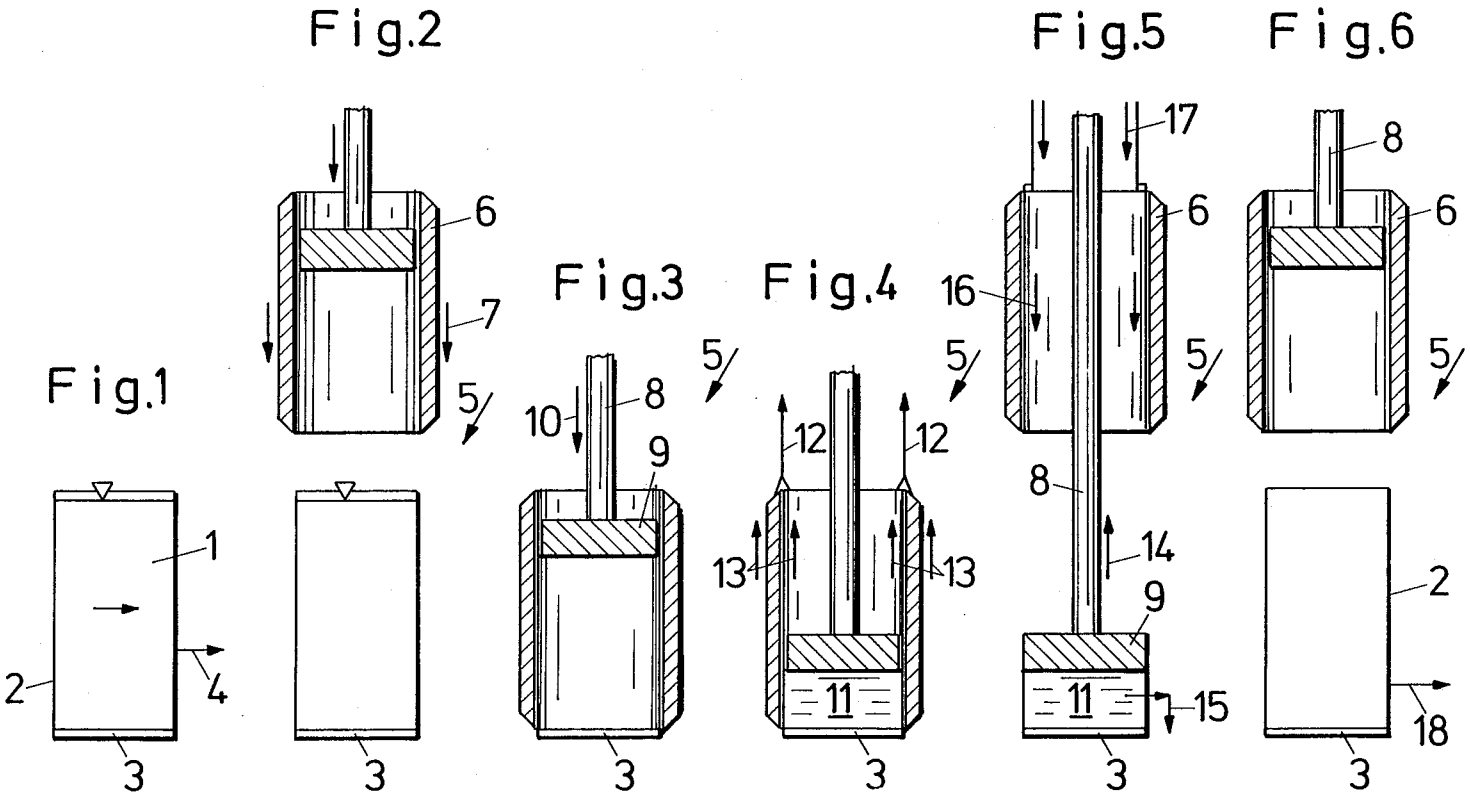

This invention relates to a process for compressing fibrous material into bales by compressing the fibrous material in several rough presses wherein the fibrous material, precompressed respectively in a thin-walled filling bin provided with a jacket all around which cannot be opened, is transported, if desired with interposition of holding stations, to a central press; each of the bins are moved one after the other with the fibrous material into the central press; the respective bin is at that location surrounded by a compression bin having ruggedly designed compression box walls; subsequently the fibrous material is further compressed and then finally compressed within the filling bin and the compression bin with box walls; and, as a last step, is packaged after removal of the walls retaining the bale; and wherein the empty, thin-walled bin, after having been united with a bin bottom, is again transported back to the rough presses.

A process of this type has been known from the prior art. According to this known process, the thin-walled bin travels with the precompressed, fibrous material into the central press where it is surrounded on all sides by the ruggedly designed compression bin walls by moving the walls laterally toward the thin-walled bin, and whereupon further compacting of the fibrous material contained in the bin takes place by means of the final press punch in a first stage. However, before the final compacting pressure is produced by means of this press punch, the thin-walled bin is withdrawn in the upward direction past the press punch so that in a second stage the final compacting pressure is absorbed only by the ruggedly designed compression bin box walls.

It has been found that the idea of transporting a lightweight container from the rough presses to the main press is very advantageous, for reasons of the saving in transporting less weight alone. There is, however, the drawback that the lightweight container, for the final compression step, must be pulled off in the upward direction from the central press so that only thereafter the compacting step on the bale can be terminated by raising the compacting pressure.

This withdrawal of the thin-walled bin from the bale, which hale is under a low compacting pressure, results in shifting in the layers of tow constituting the fibrous material in the zone of the sidewalls of the bale; this constitutes a very substantial impediment to the subsequent drawing off of the tow from the bales for the further processing of the fiber tow. Besides, it cannot be avoided in this process that residual fiber components come into contact with the compression box walls at the central press and contaminate these walls. In some cases, such fibers are also caught in the longitudinal slots of the vertically abutting compression box walls so that, when the compression box walls are pulled off for packaging the bale, damage to the fibers can occur which tears the bale at least in part.

These disadvantages are not displayed by the process of DOS No. 2,906,229. In this process, ruggedly designed, i.e. thick-walled compression bins, already utilized in the rough press, travel though the manufacturing hangar to the central press to that the bale can be subjected to the finishing compacting step while in these bins. However, disadvantages in this process are the transportation of the heavy compression bins through the manufacturing hangar and also the production costs for the large number of respectively necessary compression boxes to be moved from the rough presses to the central press.

The invention is based on the object of developing a process and apparatus for conducting baling of fibrous material wherein the disadvantages of the two conventional treatment methods for manufacturing synthetic fiber bales are avoided while retaining the respective advantages thereof.

Starting with the process of the type heretofore described, the invention provides, for solving the posed problem, that the fibrous material is also finally compacted in the thin-walled bin which still is surrounded by the box walls of the compression bin, whereafter, at least the thin-walled container is shifted with respect to the compressed material, and then the bale—as is conventional—is packaged. It is advantageous to shift, after the final compacting step, the thin-walled bin as well as the walls of the compression bin of the central press jointly and simultaneously with respect to the compressed material and then—as known—perform the packaging step. Thus, while the walls are pulled off the bale, the thin-walled bin is considered to be a unit with the heavy walls of the compression bin.

In the central press for performing the process according to this invention, the box walls of the compression bin can be moved around the thin-walled filling bin to receive the filling bin. In the previously known device, the four compression box walls are in each case advanced laterally. Apart from this expensive structure, longitudinal gaps between the abutting walls cannot be precluded. Advantageously, devices are provided according to this invention by means of which the all-around closed bin as well as the compression box walls can be removed relatively to the material which is under compacting pressure. Suitably, both containers or bins are pulled off simultaneously, for example, in the upward direction. It is also possible to make the compression bin of a jacket that cannot be opened all around, but must now, in this arrangement, be placeable over the thin-walled container.

The drawing illustrates, a series of steps performed at the central press, respectively, in FIGS. 1 to 6 which are schematic views of the apparatus for conducting the process. The invention will be described in greater detail with reference to the drawing wherein FIGS. 1 to 6 also provide schematic elevational views of the filling bin, compression bin and central press as well as the means for withdrawing the bins from the finally compacted bale, and the means for separating the bins from each other.

The filling bin 2, to be filled with fiber material 1, is provided in the arrangement serving for performing the process of this invention with a relatively thin-walled jacket. The walls of the filling bin need merely withstand the lateral pressure produced in the rough press. The filling bin 2 is made up of a jacket, closed all around, with a bottom 3 that can be detached therefrom. Customarily, the bottom is covered with a plastic sheet before the bin is filled; this sheet is used later on, after compacting of the fiber material, for packaging the bale. The packaging procedure is not illustrated in the drawing for simplicity's sake, but is the subject of the compression-packaging process to be performed. In this connection, reference is had, for example, to the content of DOS No. 2,906,229.

Thus, the filling bin 2 is filled in the rough press with loose fiber material or with endless fiber tow up to the level in the region of the top edge. Subsequently, this bin, and also additional bins from other rough presses, travel in accordance with arrow 4 to the main or central press, see FIGS. 1 and 2. Together with the bin bottom, the filling bin 2 enters the compacting position in the central press 5; for this purpose the more ruggedly structured box walls of the compression bin 6 are maintained at levels above the height required for entrance into the press. Subsequently, the compression box wall 6 are moved in correspondence with arrow 7 over the filling bin 2 that has been fitted in place in the press. (See FIG. 3).

In this embodiment, the walls of the compression bin or box, just as those of the filling bin, are provided all around with a jacket structure that cannot be opened on the sides. This compression box 6, however, can also be exchanged for a construction wherein one wall or three walls can be pivoted outwardly in order to surround the filling bin 2 only in the lowered condition. This construction, however, is expensive and requires air gaps at the abutting compression box walls, which constitutes a disadvantage, just as in case of a structure wherein the compression box walls, which constitutes a disadvantage, just as in case of a structure wherein the compression box walls are shifted laterally with respect to one another. In any event, the walls of the compression box 6, in the condition shown in FIG. 3, or after the locking means of the optionally movable compression box walls has been closed, should encompass the bin 2 with only a small air gap.

After lowering the compression bin or box 6 in accordance with the illustration in FIG. 3, the filling bin 2, equipped with a thin-walled jacket, is consequently made secure against the high compacting pressure produced in the central press 5. At this point in time, the ram 8 of the press punch 9 travels downwardly into the filling bin 2 in correspondence with arrow and compacts, in one compression step, the fiber material 1 in order tot obtain the bale 11 in the final compacted condition. According to FIG. 4, the walls of the compression box 6 as well as the jacket of the filling bin 2 travel upwardly with the aid of correspondingly provided pulling devices 12. During this uncovering of the bale 11, the compacting pressure is unaltered and maintained high. Destruction of the tin-walled container jacket during the pulling-up step is impossible since this jacket is likewise still under the same protection by the walls of the compression box 6 against lateral pressures as a consequence of the compacting pressure produced by the press punch 9.

In the condition according to FIG. 5, the bale 11 is packaged with the sheet placed on the bottom 3 and optionally with a further sheet placed from above on the fiber material prior to the compression step, and, if desired, with the length of sheet wrapped around along the side, and is then reinforced. On account of this procedure, the press punch 9 can now travel upwardly in the direction of arrow 14 and release the bale 11 for being carried away according to arrow 15. At the same time, the jacket of the filling bin 2 is shifted downwardly as per arrows 16 out of the compression box walls 6 by means of separating devices 17 provided therein. Having arrived at the bottom of the press, the jacket is reunited with the bottom 3 in order to return, thus completed, in the direction of arrow 18 to the rough presses. The presently vacated space can again be occupied by a new thin-walled container jacket, according to FIGS. 1 and 2.

What is claimed is:

1. A process for compressing fibrous materials into bales, which comprises:

transporting fibrous material precompressed into a rough bale within a thin-wall filling bin to a central press, said thin-walled filling bin having a bin bottom secured to a thin-walled jacket which extends completely around sides of the rough bale of fibrous material;

surrounding the jacket of the filling bin with strong thick walls of a compression bin;

further compressing the rough bale in a central press within the filling bin surrounded by the walls of the compression bin to provide a compressed bale of fibrous material;

removing walls of the compression bin and the jacket of the thin-walled filling bin from the bale;

shifting the compressed bale away from the bin bottom; and thereafter securing the jacket of the filling bin to the bin bottom to form an empty filling bin.

2. A process according to claim 1, wherein the empty thin-walled filling bin is transported to a rough press wherein another rough bale is precompressed within said filling bin.

3. A process according to claim 1, wherein the walls of the compression bin, as well as the jacket of the thin-walled filling bin are lifted upwardly away from the compressed bale.

4. A process according to claim 1, wherein after the walls of the compression bin and the jacket of the thin-walled filling bin have been removed from the bale, the jacket of the filling bin is shifted away from the walls of the compression bin and towards the bin bottom.

5. A process according to claim 1, wherein after the compressing step in the central press, the thin-walled bin, as well as the walls of the compression bin are shifted jointly and simultaneously relative to the compressed bale and to a punch press of the central press.

6. An apparatus for compressing fibrous material into bales, which comprises:

a thin-walled filling bin having a bin bottom detachably secured to a thin-walled jacket which extends completely around sides of a rough bale of fibrous material within said filling bin;

a central press having a punch press operatively associated with a compression bin, said compression bin having strong thick walls and being movable with respect to the punch press;

means for shifting the compression bin towards the thinwalled filling bin containing the rough bale so that the walls of the compression bin surround the jacket of the filling bin;

means for moving the punch press of the central press downwardly into the jacket of the filling bin to effect compression of the rough bale; and pulling means for moving the filling bin as well as the walls of the compression bin upwardly away from the compressed bale that is retained under high compacting pressure by said punch press.

7. An apparatus according to claim 6, wherein said pulling means comprises a pair of pulling devices, one pulling device being attached to the thin-walled jacket of the filling bin and the other device being attached to walls of the compression bin so that the jacket and the walls of the compression bin can be pulled off of the compressed bale simultaneously in an upward direction.

8. An apparatus according to claim 6, wherein said jacket of the filling bin completely surrounds the rough bale and cannot be opened and the compression bin has walls which are secured together and cannot be separated, said apparatus further comprising means for moving the jacket of the filling bin relative to the compression bin.

9. An apparatus according to claim 6, further comprising a separating device for moving the filling bin downwardly independently of the compression bin.

10. An apparatus according to claim 6, wherein the compression bin comprises a continuous non-openable jacket which is slideable over the thin-walled filling bin.

* * * * *